United States Patent [19]

Imamura et al.

[11] Patent Number: 4,530,894

[45] Date of Patent: Jul. 23, 1985

[54] COATED MAGNETIC TONER POWDER

[75] Inventors: Tetsuya Imamura; Takashi Takeuchi; Takashi Tetsutani, all of Utsunomiya; Shinichiro Yasuda, Wakayama, all of Japan

[73] Assignee: Kao Corporation, Tokyo, Japan

[21] Appl. No.: 602,587

[22] Filed: Apr. 20, 1984

[30] Foreign Application Priority Data

Apr. 28, 1983 [JP] Japan ..... 58-75321
Apr. 28, 1983 [JP] Japan ..... 58-75324
Apr. 28, 1983 [JP] Japan ..... 58-75325

[51] Int. Cl.[3] ..... G03G 9/14
[52] U.S. Cl. ..... 430/106.6; 428/405
[58] Field of Search ..... 430/106.6; 428/405

[56] References Cited

U.S. PATENT DOCUMENTS 4,070,296 1/1978 Gibson et al. ..... 430/106
4,336,318 6/1982 Fukumoto et al. ..... 430/106.6 X
4,464,452 8/1984 Gruber et al. ..... 430/106.6 X

*Primary Examiner*—John D. Welsh
*Attorney, Agent, or Firm*—Flynn, Thiel, Boutell & Tanis

[57] ABSTRACT

A magnetic toner comprises magnetic powder and a coating layer to cover said powder, the layer being a reaction product between (1) a silane coupling agent containing an amino group, an isocyanate group or an epoxy group and (2) one or more compounds having a functional group reactive with one of the reactive group on the silane coupling agent. A compound having a carboxyl group, an acid anhydride, an isocyanate compound or a ketene dimer is used for the amino group. A compound having a hydroxyl group, an amine compound or a compound having a carboxyl group is used for the isocyanate group. A compound having a hydroxyl group, a compound having a carboxyl group or a copolymer of a di- or monoalkylamino-alkyl (meth-)acrylate and a hydrophobic vinyl monomer is used for the epoxy group. The magnetic toner is improved about dispersibility in a binder.

7 Claims, No Drawings

COATED MAGNETIC TONER POWDER

The present invention relates to a magnetic toner used for developing an electric or magnetic latent image in an electrophotography or electrostatic printing method.

There have been known various electrophotographic and electrostatic printing methods as described in, for example, "Gazo Denshi Gakkia-shi [5, No. 4, 175 (1976)]. A generally employed process comprises forming an electric latent image on a photosensitive material containing a photoconductive substance by various means, developing the latent image with a toner, transferring, if necessary, the powder image of the toner onto a printing material such as paper and fixing the same by heating or by applying pressure or solvent vapor to obtain a copy.

The developers include two-component toner developers comprising (1) a toner obtained by dispersing a dye or a pigment in a synthetic resin, wax or natural resin and (2) a reduced iron or ferrite grain carrier and one-component toner developers comprising magnetic toners obtained by dispersing a magnetic powder such as magnetite powder in a synthetic resin, wax or natural resin.

The one-component developing process has an advantage that a developing device having a simple and compact structure may be employed, since the carrier-free developer is used therein and, therefore, the control of the mixing ratio of the carrier to the toner is unnecessary and no operation of stirring the carrier and the toner to obtain a homogeneous mixture is particularly required.

Further, this process does not have a defect of reduction of the developed image quality due to deterioration of the carrier with time.

However, it is required for obtaining the magnetic toner to homogeneously disperse the inorganic magnetic powder having a high surface energy in the resin or wax having a low surface energy. The homogeneous dispersion is, however, difficult to obtain, since the affinity of the magnetic powder with the resin is poor. Under these circumstances, there have been proposed a process wherein the two components are kneaded together for a lon time and a process wherein a kneader which requires a high kneading energy is employed for obtaining the homogeneous dispersion. However, the magnetic powder cannot be dispersed uniformly. Further, even when the homogeneous dispersion is obtained, the magnetic powder might be separated from the toner when the blend is pulverized to obtain the toner or when the toner is used practically in a copying machine. The thus isolated magnetic powder damages the photosensitive material or exerts a harmful influence on the characteristics of the photosensitive material so that no stable image can be obtained.

Various processes have been proposed for overcoming the above-mentioned defects of the magnetic toners. For example, there have been proposed a process wherein the surface of the magnetic powder is coated with an aliphatic compound having a melting point of 40° to 200° C. to improve the physical and chemical stabilities of the toner (Japanese Patent Laid-Open No. 139745/1975), a process wherein the surface of the magnetic powder is coated with an acrylic resin or styrene resin to prevent the reduction of the transfer efficiency in a high-humidity atmosphere (Japanese Patent Laid-Open No. 130130/1979) and a process wherein the magnetic powder treated with a reactive silane compound is dispersed in a copolymerizable monomer and polymerizing the monomer by suspension polymerization process to improve the dispersibility of the magnetic powder in the resin and also to prevent the liberation of the magnetic powder from the toner (Japanese Patent Laid-Open No. 7646/1983). However, it is still difficult to disperse the magnetic powder such as magnetite easily and uniformly in the resin or wax even by these processes. The bonding strength between the magnetic powder and the resin or wax is unsatisfactory.

After intensive investigations of magnetic toners under these circumstances, the inventors have found that a magnetic toner containing a magnetic powder homogeneously dispersed therein wherein the bonding strength between the magnetic powder and the resin or wax is high can be obtained by coating the magnetic powder with a reaction product as defined below. The invention relates to a magnetic toner which comprises magnetic powder and a coating layer to cover said powder which layer comprises a reaction product between (1) a silane coupling agent containing an amino group, an isocyanate group or an epoxy group and (2) one or more compounds selected from the group consisting of the following compounds (I) through (X) having a functional group reactive with one of the above-mentioned groups, The compounds (I) to (IV) to react with the amino-containing silane coupling agent:

(I) a compound having a carboxyl group and a molecular weight of at least 100, (II) an acid anhydride having a molecular weight of at least 100, (III) an isocyanate compound having a molecular weight of at least 100, and (IV) a ketene dimer having 12 to 52 carbon atoms, The compounds (V) to (VII) to react with the isocyanate-containing silane coupling agent:

(V) a compound having a hydroxyl group and a molecular weight of at least 100, (VI) an amine compound having a molecular weight of at least 100, and (VII) a compound having a carboxyl group and a molecular weight of at least 100, The compounds (VIII) to (X) to react with the epoxy-containing silane coupling agent:

(VIII) a compound having a hydroxyl group and a molecular weight of at least 100, (IX) a compound having a carboxyl group and a molecular weight of at least 100, and (X) a copolymer of a di- or monoalkylaminoalkyl (meth)acrylate and a hydrophobic vinyl monomer.

The amino group-containing silane coupling agents usable in the present invention include, for example, the following compounds:

$H_2NC_2H_4NHC_3H_6Si(OCH_3)_3$,
$H_2NC_2H_4NHC_3H_6Si(CH_3)—(OCH)_3)_2$,
$H_2NC_3H_6Si(OC_2H_5)_3$, $H_2NCONHC_3H_6Si—(OC_2H_5)_3$, and

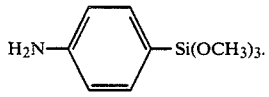

Though the above-mentioned compounds (I) to (IV) used in the present invention are not particularly limited, those which do not substantially react with the amino group-containing silane coupling agent due to steric hindrance are excluded. Typical groups of the respective compounds (I) to (IV) and particular names of the compounds will be shown below (as for the isocyanate compounds, only the compound names will be shown).

(I) Compounds having a carboxyl group and a molecular weight of at least 100:

Compound groups:

higher fatty acids having 8 to 22 carbon atoms, homopolymers and copolymers of $\alpha,\beta$-unsaturated carboxylic acids, and copolymers containing $\alpha,\beta$-unsaturated carboxylic acids.

Examples of the compounds:

lauric acid, myristic acid, palmitic acid, stearic acid, oleic acid, polyacrylic acid, polymethacrylic acid, polymaleic acid, acrylic acid/maleic acid copolymer, maleic acid/$\alpha$-olefin copolymer and methacrylic acid/styrene copolymer, (II) Acid anhydrides having a molecular weight of at least 100:

Compound groups:

acid anhydrides having 4 to 32 carbon atoms, polymers of maleic anhydride, and copolymers containing maleic anhydride.

Examples of the compounds:

octadecylsuccinic anhydride, dodecenylsuccinic anhydride, polymaleic anhydride, maleic anhydride/methacrylic acid copolymer and maleic anhydride/$\alpha$-olefin copolymer.

(III) Isocyanate compounds having a molecular weight of at least 100:

Examples of the compounds:

diphenylmethane diisocyanate, tolylene diisocyanate, hexamethylene diisocyanate, compounds having a terminal isocyanato group derived from polytetramethylene glycol and diphenylmethane diisocyanate, compounds having a terminal isocyanato group derived from 1 mol of an ester having a terminal hydroxyl group (obtained from 1,4-butanediol and adipic acid) and 2 mol of tolylene diisocyanate, compounds having three isocyanato groups derived from 1 mol of trimethylolpropane and 3 mol of diphenylmethane diisocyanate, and compounds having four isocyanato groups derived from 1 mol of pentaerythritol and 4 mol of tolylene diisocyanate.

(IV) Ketene dimers having 12 to 52 carbon atoms:

Compound groups:

ketene dimers having the following general formula:

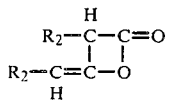

wherein $R_1$ and $R_2$ represent each a hydrocarbon group having 4 to 24 carbon atoms.

Examples of the compounds:

octylketene dimer, octadecylketene dimer, eicosylketene dimer, octenylketene dimer, octadecenylketene dimer and dodecylphenylketene dimer.

The isocyanato group-containing silane coupling agents usable in the present invention include, for example, the following compounds:

$(C_2H_5O)_3SiC_3H_6NHCONHC_6H_{12}NCO$ $(CH_3O)_3SiC_3H_6NHC_2H_4NHCONHC_6H_{12}NCO$ $(CH_3O)_2Si(CH_3)C_3H_6NHC_2H_4NHCONHC_6H_{12}NCO$

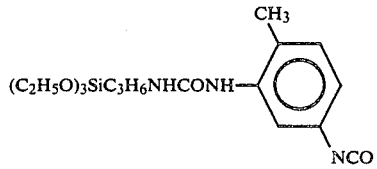

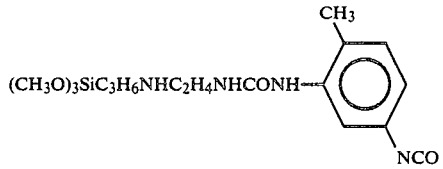

$(C_2H_5O)_3SiC_3H_6NC_2H_4NHC_6H_{12}NCO$
$\quad\quad\quad copolymerizable double bond and a hydroxyl group in the molecule, and copolymers containing a monomer having a copolymerizable double bond and a hydroxyl group in the molecule.

Examples of the compounds:

lauryl alcohol, myristyl alcohol, palmityl alcohol, stearyl alcohol, monododecyl phosphate, didodecyl phosphate, sesquidodecyl phosphate, sesquipropyl phosphate, sesquidodecylpolyoxyethylene(3) phosphate, monooctadecylpolyoxyethylene(5) phosphate, sesquidodecylpolyoxypropylene(9) phosphate, $[C_{11}H_{23}COO(CH_2CH_2O)_{10}]_{1.5}PO(OH)_{1.5}$, $C_{17}H_{35}COO(CH_2CH_2O)_{15}PO(OH)_2$, $[C_5H_{11}COO(CH_2CH_2O)_2]_2PO(OH)$, polyhydroxylethyl methacrylate and hydroxyethyl methacrylate/methyl acrylate copolymer.

(VI) Amine compounds having a molecular weight of at least 100:

Compound groups:

primary, secondary and tertiary amines of the general formulae:

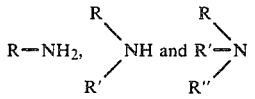

wherein R, R′ and R″ represent each an alkyl group, and polyalkylenepolyamines.

Examples of the compounds:

stearylamine, dihexadecylamine, tridecylamine and diethylenetriamine.

(VII) Compounds having a carboxyl group and a molecular weight of at least 100:

Compound groups:

higher fatty acids having 8 to 32 carbon atoms, homopolymers of a vinyl monomer having a carboxyl group, copolymers containing a vinyl monomer having a carboxyl group, and compounds having a terminal carboxyl group obtained from 1 mol of a diol and 2 mol of a dicarboxylic acid.

Examples of the compounds:

caproic acid, myristic acid, stearic acid, polymethacrylic acid, methacrylic acid/lauryl methacrylate copolymer and an ester having a terminal carboxyl group obtained by an esterification reaction of 1 mol of ethylene glycol and 2 mol of adipic acid.

The epoxy group-containing silane coupling agents usable in the present invention include, for example, the following compounds:

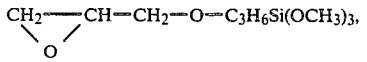

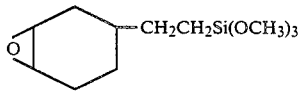

Though the above-mentioned compounds (VIII) to (X) used in the present invention are not particularly limited, those which do not substantially react with the epoxy group-containing silane coupling agent due to steric hindrance are excluded. Typical groups of the respective compounds (VIII) to (X) and particular names of the compounds will be shown below.

(VIII) Compounds having a hydroxyl group and a molecular weight of at least 100:

Compounds:

higher alcohols having 8 to 22 carbon atoms.

Examples of the compounds:

lauryl alcohol, palmityl alcohol and stearyl alcohol.

(IX) Compounds having a carboxyl group and a molecular weight of at least 100:

Compounds:

higher fatty acids having 8 to 32 carbon atoms.

Examples of the compounds:

lauric acid, palmitic acid, myristic acid, stearic acid, oleic acid and linoleic acid.

(X) Copolymers of a di- or monoalkylaminoalkyl (meth)acrylate with a hydrophobic vinyl monomer:

Compounds:

copolymers comprising 5 to 50 molar % of a di- or monoalkyl aminoalkyl (meth)acrylate and 50 to 95 molar % of a hydrophobic vinyl monomer.

The di- or monoalkylaminoalkyl (meth)acrylates include, for example, dimethylaminoethyl (meth)acrylate, dimethylaminomethyl (meth)acrylate, diethylaminopropyl (meth)acrylate and N-tert-butylaminoethyl (meth)acrylate.

The hydrophobic vinyl monomers include, for example, (meth)acrylates, α-olefins, styrene, acrylonitrile and butadiene.

The copolymers of the dialkylaminoalkyl (meth)acrylate and the hydrophobic vinyl monomer contain preferably at least 5 molar % of the alkylaminoalkyl (meth)acrylate. When the amount of the (meth)acrylate is less than 5 molar %, the bond with the epoxy group is insufficient.

Examples of the compounds:

dimethylaminoethyl methacrylate (DMAEMA)/hexyl methacrylate (HMA) copolymer (DMAEMA/HMA molar ratio: 5/95), dimethylaminoethyl methacrylate (DMAEMA)/styrene (St) copolymer (DMAEMA/St molar ratio: 15/85) and N-tert-butylaminoethyl methacrylate (MATBAE)/hexyl methacrylate (HMA) copolymer (MATBAE/HMA molar ratio: 5/95).

Processes for preparing the magnetic powder coated with the reaction product of the amino group-containing silane coupling agent and the compound(s) selected from the above-mentioned compounds (I) to (IV) are not limited in the present invention. The processes are, for example, as follows:

(a) a process wherein the magnetic powder (i) is heat-treated with the amino group-containing silane coupling agent (ii) in an inert organic solvent and then with one or more compounds (iii) selected from the group consisting of the above-mentioned compounds (I) to (IV), (b) a process wherein the above-mentioned compounds (i), (ii) and (iii) are mixed together at once in an inert organic solvent and the mixture is heat-treated, and (c) a process wherein the compound (ii) is reacted with the compound (iii) in an inert organic solvent, then the compound (i) is added to the reaction product and the mixture is heat-treated.

The amount of the amino group-containing silane coupling agent used in the present invention is about 0.1 to 5 wt.%, preferably about 0.5 to 1.5 wt.%, based on the magnetic powder. The amount of the compound(s) selected from the group consisting of the above-mentioned compounds (I) to (IV) is 2 to 4 parts by weight per part by weight of the amino group-containing silane coupling agent.

The inert solvents usable in the treatment of the magnetic powder include, for example, benzene, toluene, xylene, methyl ethyl ketone, methyl isobutyl ketone, diethyl ketone and cyclohexanone. The amount of the solvent is not particularly limited and it is controlled so as to obtain a suitable viscosity of the reaction mixture.

The magnetic powders usable in the production of the magnetic toners of the present invention include all of magnetic materials used for the production of magnetic toners in the prior art. They include, for example, powdered magnetite, ferrite, iron, nickel and cobalt.

An important feature of the present invention is that the magnetic powder is coated with the reaction product of the amino group-containing silane coupling agent and the compound(s) selected from the group consisting of the above-mentioned compounds (I) to (IV) having a functional group reactive with the amino group. When the magnetic powder is coated with a reaction product obtained from a compound unreactive with the amino group, no magnetic toner having satisfactory performance can be obtained.

The following examples will further illustrate the present invention, which by no means limit the invention. In the following examples and comparative examples, parts are given by weight.

Each of magnetic toner obtained in the below mentioned examples and comparative examples was examined in respect to dispersibility in resin, dispersibility in max and separation. Before reference to examples, methods of preparing magnetic toner and methods of examination are shown.

Preparation of Magnetic Toner (1)

55 parts of the surface-coated magnetite obtained as above was mixed with 45 parts of a bisphenolic polyester resin (Newtlac 382A; a product of Kao Soap Co., Ltd.). The resulting mixture was kneaded by passing the same once through a twin extruding kneader, then roughly pulverized by means of a pulverizer (registered trade name: Pulverizer) of Hosokawa Micron Co., Ltd. and finely pulverized by means of a gas stream jet mill. The resulting fine powder was shaped into globules with hot air at 230° C. and classified by means of a cyclone to obtain a magnetic toner having an average particle size of 12 to 13 μm.

Preparation of Magnetic Toner (2)

60 parts of the surface-coated magnetite was mixed with 40 parts of polyethylene wax having a melting point of 108° C. The resulting mixture was treated in the same manner as in the above-mentioned process for the preparation of magnetic toner (1) to obtain a magnetic toner having an average particle diameter of 12 to 13 μm.

Preparation of Magnetic Toner (3)

80 parts of the above-mentioned, surface-coated magnetite was mixed with 20 parts of methyl methacrylate (MMA)/styrene (St) copolymer (MMA/St molar ratio: 50/50; molecular weight: 20,000). The resulting mixture was treated in the same manner as in the above-mentioned process for the preparation of magnetic toner (1) to obtain a fine powder. The powder was granulated with hot air at 250° C. and classified by means of a cyclone to obtain a magnetic toner having an average particle size of 25 μm.

In the preparation (3), the copolymer having a molecular weight of 20,000 was used with regard to Examples 1 through 7 and Comparative Examples 1 to 3. That having a molecular weight of 700,000 was used in respect to Examples 8 through 15 and Comparative Examples 4 and 5. That having a molecular weight of 200,000 was used in connection with Examples 16 through 18 and Comparative Examples 6 and 7.

Evaluation of Dispersibility of Magnetic Powder

A given amount of each of the magnetic toners obtained by the above-mentioned processes (1) and (2) was placed on a sheet of white paper and the state of the dispersion of the magnetic powder was observed by means of a microscope. The results were represented by three ranks of 1 to 3, 3 meaning that uneven distribution of magnetite was not recognized at all (high dispersibility) and 1 meaning that the uneven distribution of magnetite could be recognized clearly and in a large amount (poor dispersibility). The results are shown in Table 1.

Evaluation of Separation of Magnetic Powder

The magnetic toner obtained by the above-mentioned process (3) was stirred in a magnetic brush unit for test for 8 h. The amount of the magnetite separated from the magnetic toner was examined. The results were represented by five ranks of 1 to 5, 5 meaning that the separation of the magnetite was not recognized at all (good) and 1 meaning that substantially the whole of magnetite was separated (bad). The results are shown in Table 1.

EXAMPLE 1

100 parts of a magnetite (EPT-500; a product of Toda Kogyo Co.), 300 parts of toluene, 1 part of $H_2NC_3H_6Si(OC_2H_5)_3$ and 3 parts of stearic acid were charged in a four-necked flask provided with a condenser and stirred at 80° C. for 2 h. Then, the magnetite was washed with a large amount of toluene and dried.

EXAMPLE 2

A surface-coated magnetite was obtained in the same manner as in Example 1 except that stearic acid was replaced with 3 parts of a maleic acid (MA)/methacrylic acid (MEA) copolymer (MA/MEA molar ratio: 50/50; molecular weight: 950). Three kinds of magnetic toners were prepared by using the surface-coated magnetite in the same manner as in Example 1. The dispersibilities and separation conditions of the magnetite were evaluated in the same manner as in Example 1. The results are shown in Table 1.

EXAMPLE 3

A surface-coated magnetite was obtained in the same manner as in Example 1 except that stearic acid was replaced with 3 parts of dodecenylsuccinic anhydride. Three kinds of magnetic toners were prepared by using the surface-coated magnetite in the same manner as in Example 1. The dispersibilities and separation conditions of the magnetite were evaluated in the same manner as in Example 1. The results are shown in Table 1.

EXAMPLE 4

A surface-coated magnetite was obtained in the same manner as in Example 1 except that stearic acid was replaced with 3 parts of Diacarna 30 (an α-olefin/- maleic anhydride copolymer of Mitsubishi Chemical Industries, Ltd.). Three kinds of magnetic toners were prepared by using the surface-coated magnetite in the same manner as in Example 1. The dispersibilities and separation conditions of the magnetite were evaluated in the same manner as in Example 1. The results are shown in Table 1.

EXAMPLE 5

A surface-coated magnetite was obtained in the same manner as in Example 1 except that the silane coupling agent was replaced with 1 part of a silane coupling agent of the formula: $H_2NC_2H_4NHC_3H_6Si(OCH_3)_3$ and stearic acid was replaced with 3 parts of 4,4'-diphenylmethane diisocyanate. Three kinds of magnetic toners were prepared by using the surface-coated magnetite in the same manner as in Example 1. The dispersibilities and separation conditions of the magnetite were evaluated in the same manner as in Example 1. The results are shown in Table 1.

EXAMPLE 6

100 parts of Teracol 1000 (polytetramethylene glycol of du Pont, having a molecular weight of 1000) was reacted with 50 parts of 4,4'-diphenylmethane diisocyanate to obtain a compound having a terminal isocyanate group. A surface-coated magnetite was obtained in the same manner as in Example 1 except that stearic acid was replaced with 4 parts of the isocyanato group-containing compound. Three kinds of magnetic toners were prepared by using the surface-coated magnetite in the same manner as in Example 1. The dispersibilities and separation conditions of the magnetite were evaluated in the same manner as in Example 1. The results are shown in Table 1.

EXAMPLE 7

A surface-coated magnetite was obtained in the same manner as in Example 1 except that stearic acid was replaced with 3.5 parts of octylketene dimer. Three kinds of magnetic toners were prepared by using the surface-coated magnetite in the same manner as in Example 1. The dispersibilities and separation conditions of the magnetite were evaluated in the same manner as in Example 1. The results are shown in Table 1.

EXAMPLE 8

100 parts of a magnetite (EPT-500; a product of Toda Kogyo Co.), 300 parts of toluene, 1 part of $(C_2H_5O)_3SiC_3H_6NHCONHC_6H_{12}NCO$ (a silane coupling agent) and 3 parts of stearyl alcohol were charged in a four-necked flask provided with a condenser and stirred at 80° C. for 2 h. Then, the magnetite was washed with a large amount of toluene and dried.

EXAMPLE 9

A surface-coated magnetite was obtained in the same manner as in Example 8 except that stearyl alcohol was replaced with 3 parts of stearylamine. Three kinds of magnetic toners were prepared by using the surface-coated magnetite in the same manner as in Example 8. The dispersibilities and separation conditions of the magnetite were evaluated in the same manner as in Example 8. The results are shown in Table 1.

EXAMPLE 10

A surface-coated magnetite was obtained in the same manner as in Example 8 except that stearyl alcohol was replaced with 3 parts of hexadecylamine. Three kinds of magnetic toners were prepared by using the surface-coated magnetite in the same manner as in Example 8. The dispersibilities and separation conditions of the magnetite were evaluated in the same manner as in Example 8. The results are shown in Table 1.

EXAMPLE 11

A surface-coated magnetite was obtained in the same manner as in Example 8 except that stearyl alcohol was replaced with 3 parts of sesquihexadecyl phosphate. Three kinds of magnetic toners were prepared by using the surface-coated magnetite in the same manner as in Example 8. The dispersibilities and separation conditions of the magnetite were evaluated in the same manner as in Example 8. The results are shown in Table 1.

EXAMPLE 12

A surface-coated magnetite was obtained in the same manner as in Example 1 except that stearyl alcohol was replaced with 3 parts of monododecylpolyoxyethylene (5) phosphate. Three kinds of magnetic toners were prepared by using the surface-coated magnetite in the same manner as in Example 8. The dispersibilities and separation conditions of the magnetite were evaluated in the same manner as in Example 8. The results are shown in Table 1.

EXAMPLE 13

A surface-coated magnetite was obtained in the same manner as in Example 8 except that stearyl alcohol was replaced with 3 parts of a phosphate of the formula: $[C_{11}H_{23}COO(CH_2CH_2O)_{10}]_{1.5}PO(OH)_{1.5}$. Three kinds of magnetic toners were prepared by using the surface-coated magnetite in the same manner as in Example 8. The dispersibilities and separation conditions of the magnetite were evaluated in the same manner as in Example 8. The results are shown in Table 1.

EXAMPLE 14

100 parts of the same magnetite as in Example 8, 500 parts of toluene, 1 part of a silane coupling agent of the formula:

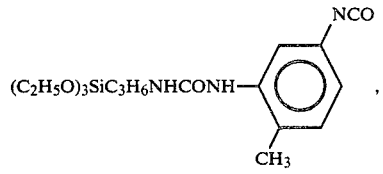

and 3 parts of a styrene (St)/methyl methacrylate (MMA)/hydroxyethyl acrylate (HEA) copolymer (St/MMA/HEA molar ratio: 60/20/20; molecular weight: 25,000) were charged in a four-necked flask provided with a condenser and stirred at 80° C. for 2 h. Then, the same procedure as in Example 8 was repeated to obtain a surface-coated magnetite. Three kinds of magnetic toners were prepared by using the surface-coated magnetite in the same manner as in Example 8. The dispersibilities and separation conditions of the magnetite were evaluated in the same manner as in Example 8. The results are shown in Table 1.

EXAMPLE 15

100 parts of the same magnetite as in Example 8, 1 part of the same silane coupling agent as in Example 8, 300 parts of toluene and 3 parts of a methacrylic acid (MMA)/lauryl methacrylate (LMA) copolymer (MMA/LMA molar ratio: 20/80; molecular weight: 2400) were charged in a four-necked flask provided with a condenser and stirred at 90° C. for 3 h. Then, the same procedure as in Example 8 was repeated to obtain a surface-coated magnetite. Three kinds of magnetic toners were prepared by using the surface-coated magnetite in the same manner as in Example 8. The dispersibilities and separation conditions of the magnetite were evaluated in the same manner as in Example 8. The results are shown in Table 1.

EXAMPLE 16

100 parts of a magnetite (EPT-500; a product of Toda Kogyo Co.), 300 parts of toluene, 1 part of

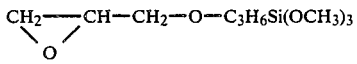

(an epoxy group-containing silane coupling agent) and 3 parts of stearyl alcohol were charged in a four-necked flask provided with a condenser and stirred at 80° C. for 2 h. Then, the magnetite was washed with a large amount of toluene and dried.

EXAMPLE 17

A surface-coated magnetite was obtained in the same manner as in Example 16 except that stearyl alcohol was replaced with 3 parts of stearic acid. Three kinds of magnetic toners were prepared by using the thus surface-coated magnetite in the same manner as in Example 16. The dispersibilities and separation conditions of the magnetite were evaluated in the same manner as in Example 16. The results are shown in Table 1.

EXAMPLE 18

A surface-coated magnetite was obtained in the same manner as in Example 16 except that stearyl alcohol was replaced with 3 parts of dimethylaminoethyl methacrylate (DMAEMA)/hexyl methacrylate (HMA) copolymer (DMAEMA/HMA molar ratio: 5/95; molecular weight: 2000). Three kinds of magnetic toners were prepared by using the surface-coated magnetite in the same manner as in Example 16. The dispersibilities and separation conditions of the magnetite were evaluated in the same manner as in Example 16. The results are shown in Table 1.

COMPARATIVE EXAMPLE 1

Three kinds of magnetic toners were prepared in the same manner as in Example 1 except that the same magnetite as in Example 1 was used directly without the surface coating. The dispersibilities and separation conditions of the magnetite were evaluated in the same manner as in Example 1. The results are shown in Table 1.

COMPARATIVE EXAMPLE 2

A magnetite surface-treated with only a silane coupling agent was prepared from the same magnetite and silane coupling agent as in Example 1 in the same manner as in Example 1. Three kinds of magnetic toners were prepared from the surface-treated magnetite in the same manner as in Example 1. The dispersibilities and separation conditions of the magnetite were evaluated in the same manner as in Example 1. The results are shown in Table 1.

COMPARATIVE EXAMPLE 3

A magnetite surface-coated with a silane coupling agent and a copolymer was prepared in the same manner as in Example 1 except that stearic acid was replaced with 3 parts of a methyl methacrylate (MMA)/styrene (St) copolymer (MMA/St molar ratio: 30/70; molecular weight: 100,000) unreactive with amino group-containing silane coupling agents. Three kinds of magnetic toners were prepared from the surface-coated magnetite in the same manner as in Example 1. The dispersibilities and separation conditions of the magnetite were evaluated in the same manner as in Example 1. The results are shown in Table 1.

COMPARATIVE EXAMPLE 4

A magnetite surface-treated with only a silane coupling agent was prepared from 100 parts of the same magnetite as Example 8, 30 parts of toluene and the same silane coupling agent as in Example 8 in a four-necked flask provided with a condenser in the same manner as in Example 8. Three kinds of magnetic toners were prepared from the surface-treated magnetite in the same manner as in Example 8. The dispersibilities and separation conditions of the magnetite were evaluated in the same manner as in Example 8. The results are shown in Table 1.

COMPARATIVE EXAMPLE 5

A magnetite surface-coated with a silane coupling agent and polymethyl methacrylate was prepared in the same manner as in Example 8 except that stearyl alcohol was replaced with polymethyl methacrylate (molecular weight: 100,000) unreactive with isocyanato group. Three kinds of magnetic toners were prepared from the surface-coated magnetite in the same manner as in Example 8. The dispersibilities and separation conditions of the magnetite were evaluated in the same manner as in Example 8. The results are shown in Table 1.

COMPARATIVE EXAMPLE 6

A magnetite surface-treated with only a silane coupling agent was prepared from 100 parts of th same magnetite as in Example 16, 300 parts of toluene and the same silane coupling agent as in Example 16 in a four-necked flask provided with a condenser in the same manner as in Example 16. Three kinds of magnetic toners were prepared from the surface-treated magnetite in the same manner as in Example 16. The dispersibilities and separation conditions of the magnetite were evaluated in the same manner as in Example 16. The results are shown in Table 1.

COMPARATIVE EXAMPLE 7

A magnetite surface-coated with a silane coupling agent and an epoxy resin was prepared in the same manner as in Example 16 except that stearyl alcohol was replaced with 3 parts of an epoxy resin (Epikote 828; a product of Shell International Chemicals Corp.) unreactive with the epoxy group. Three kinds of magnetic toners were prepared from the surface-coated magnetite in the same manner as in Example 16. The dispersibilities and separation conditions of the magnetite were evaluated in the same manner as in Example 16. The results are shown in Table 1.

TABLE 1

| Magnetic toner | Dispersibility in resin | Dispersibility in max | Separation |
|---|---|---|---|
| Example | | | |
| 1 | 3 | 3 | 5 |
| 2 | 3 | 3 | 5 |
| 3 | 3 | 3 | 5 |
| 4 | 3 | 3 | 5 |
| 5 | 3 | 3 | 5 |
| 6 | 3 | 3 | 5 |
| 7 | 3 | 3 | 5 |
| 8 | 3 | 3 | 4 |
| 9 | 3 | 3 | 5 |
| 10 | 3 | 3 | 5 |
| 11 | 3 | 3 | 5 |
| 12 | 3 | 3 | 5 |
| 13 | 3 | 3 | 5 |
| 14 | 3 | 3 | 5 |
| 15 | 3 | 3 | 5 |
| 16 | 3 | 3 | 5 |
| 17 | 3 | 3 | 5 |
| 18 | 3 | 3 | 5 |
| Comp. Ex. | | | |
| 1 | 1 | 1 | 2 |
| 2 | 1 | 2 | 3 |
| 3 | 2 | 2 | 3 |
| 4 | 1 | 2 | 3 |
| 5 | 2 | 2 | 3 |
| 6 | 2 | 1 | 3 |
| 7 | 2 | 2 | 3 |

The embodiments of the invention in which an exclusive property or privilege is claimed are defined as follows:

1. A magnetic toner comprising a homogeneous dispersion of a magnetic powder in a resin or wax effective as a binder for said powder, the particles of said magnetic powder being coated with a coating layer, said coating layer comprising the product of the reaction between (1) a silane coupling agent containing a reactive group selected from the group consisting of an amino group, an isocyanate group and an epoxy group, with (2) one or more compounds containing a functional group that is reactive with said reactive group of said silane coupling agent, wherein (a) when said silane coupling agent (1) contains an amino group, said compound (2) is selected from the group consisting of I. higher fatty acids having 8 to 22 carbon atoms, homopolymers and copolymers of $\alpha,\beta$-unsaturated carboxylic acids, copolymers containing $\alpha,\beta$-unsaturated carboxylic acids, II. acid anhydrides having 4 to 32 carbon atoms, polymers of maleic anhydride, copolymers containing maleic anhydride, III. diphenylmethane diisocyanate, tolylene diisocyanate, hexamethylene diisocyanate, compounds having a terminal isocyano group derived from polytetramethylene glycol and diphenylmethane diisocyanate, compounds having a terminal isocyanato group derived from 1 mol of an ester having a terminal hydroxyl group obtained from 1,4-butanediol and adipic acid and 2 mols of tolylene diisocyanate, compounds having three isocyanato groups derived from 1 mol of trimethylolpropane and 3 mols of diphenylmethane diisocyanate, and compounds having four isocyanato groups derived from 1 mol of pentaerythritol and 4 mols of tolylene diisocyanate, and IV. ketene dimers having the following formula:

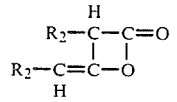

wherein $R_1$ and $R_2$ each represent a hydrocarbon group having 4 to 24 carbon atoms, (b) when said silane coupling agent contains an isocyanate group, said compound (2) is selected from the group consisting of V. higher alcohols having 8 to 22 carbon atoms, phosphates of the formula:

$$(RO)_lPO(OH)_{3-l}$$

wherein R represents an alkyl or alkenyl group and l represents a number of 1, 1.5 or 2, phosphates of the formula:

$$[RO(AO)_n]_lPO(OH)_{3-l}$$

wherein R and l have the same meanings as defined above, A represents an alkylene group having 2 to 4 carbon atoms, and n represents an integer of 1 to 30, phosphates of the formula:

$$[RCOO(AO)_n]_lPO(OH)_{3-l}$$

wherein R, A, l and n having the same meanings as defined above, partial esters of polyhydric alcohols with fatty acids, homopolymers and copolymers of monomers having a copolymeriable double bond and a hydroxyl group in the molecule, copolymers containing a monomer unit having a copolymerizable double bond and a hydroxyl group in the molecule, VI. primary, secondary and tertiary amines of the formulae:

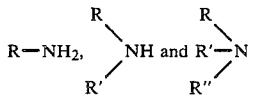

wherein R, R′ and R″ each represent an alkyl group, polyalkylenepolyamines,

VII. higher fatty acids having 8 to 32 carbon atoms, homopolymers of a vinyl monomer having a carboxyl group, copolymers containing a vinyl monomer having a carboxyl group, and compounds having a terminal carboxyl group obtained from 1 mol of a diol and 2 mol of a dicarboxylic acid, and (c) when said silane coupling agent contains an epoxy group, said compound (2) is selected from the group consisting of VIII. higher alcohols having 8 to 22 carbon atoms, IX. higher fatty acids having 8 to 32 carbon atoms, and X. copolymers comprising 5 to 20 molar % of a di- or monoalkyl aminoalkyl acrylate or methacrylate and 50 to 95 molar % of a hydrophobic vinyl monomer.

2. A magnetic toner as claimed in claim 1, in which said coating layer comprises (1) a reaction product between the amino-containing silane coupling agent and (2) one or more compounds (I) or (IV).

3. A magnetic toner as claimed in claim 1, in which said coating layer comprises a reaction product between (1) the isocyanate-containing silane coupling agent and (2) one or more compounds (V) to (VII).

4. A magnetic toner as claimed in claim 1, in which said coating layer comprises a reaction product between (1) the epoxy-containing silane coupling agent and (2) one or more compounds (VIII) to (X).

5. A magnetic toner as claimed in claim 2 in which said amino-containing silane coupling agent is selected from the group consisting of $H_2NC_2H_4NHC_3H_6Si(OCH_3)_3$, $H_2NC_2H_4NHC_3H_6Si(CH_3)—(OCH_3)_2$, $H_2NC_3H_6Si(OC_2H_5)_3$, $H_2NCONHC_3H_6Si(OC_2H_5)_3$,

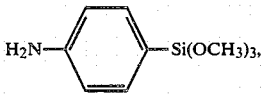

said compound (I) is selected from the group consisting of lauric acid, myristic acid, palmitic acid, stearic acid, oleic acid, polyacrylic acid, polymethacrylic acid, polymaleic acid, acrylic acid/maleic acid copolymer, maleic acid/α-olefin copolymer and methacrylic acid/styrene copolymer, said compound (II) is selected from the group consisting of octadecylsuccinic anhydride, dodecenylsuccinic anhydride, polymaleic anhydride, maleic anhydride/methacrylic acid copolymer and maleic anhydride/α-olefin copolymer, and said compound (IV) is selected from the group consisting of octylketene dimer, octadecylketene dimer, eicosylketene dimer, octenylketene dimer, octadecenylketene dimer and dodecylphenylketene dimer.

6. A magnetic toner as claimed in claim 3 in which said isocyanate-containing silane coupling agent is selected from the group consisting of $(C_2H_5O)_3SiC_3H_6NHCONHC_6H_{12}NCO$ $(CH_3O)_3SiC_3H_6NHC_2H_4NHCONHC_6H_{12}NCO$ $(CH_3O)_2SiC_3H_6NHC_2H_4NHCONHC_6H_{12}NCO$
$\quad\quad\quad

UNITED STATES PATENT AND TRADEMARK OFFICE

CERTIFICATE OF CORRECTION

PATENT NO. : 4 530 894

DATED : July 23, 1985

INVENTOR(S) : Tetsuya Imamura et al

It is certified that error appears in the above-identified patent and that said Letters Patent is hereby corrected as shown below:

Column 14, lines 1-5; correct the formula to read as follows:

---

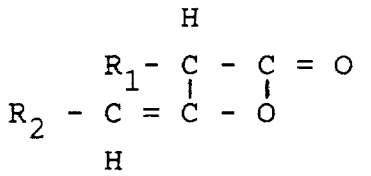

---.

Column 16, line 22; change "$(CH_2CH_2O)_{1-}$" to

---$(CH_2CH_2O)_{15-}$ ---.

line 23; change "$5PO(OH)_2$," to ---$PO(OH)_2$,---.

Signed and Sealed this

Twenty-eighth Day of January 1986

[SEAL]

Attest:

DONALD J. QUIGG

Attesting Officer

Commissioner of Patents and Trademarks